US010287147B1

(12) United States Patent
Baugh

(10) Patent No.: US 10,287,147 B1
(45) **Date of Patent: *May 14, 2019**

(54) REVERSING LEADSCREW APPARATUS, SYSTEM AND METHOD

(71) Applicant: Reel Power Licensing Corp., Oklahoma City, OK (US)

(72) Inventor: Benton Frederick Baugh, Houston, TX (US)

(73) Assignee: Reel Power Licensing Corp., Oklahoma City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/118,852

(22) Filed: Aug. 31, 2018

Related U.S. Application Data

(63) Continuation of application No. 15/354,701, filed on Nov. 17, 2016, now Pat. No. 10,093,522.

(60) Provisional application No. 62/256,818, filed on Nov. 18, 2015.

(51) Int. Cl.
*B66D 1/38* (2006.01)
*B66D 1/36* (2006.01)

(52) U.S. Cl.
CPC ..... *B66D 1/38* (2013.01); *B66D 1/36* (2013.01); *B66D 2700/0191* (2013.01)

(58) Field of Classification Search
CPC ... B66D 1/38; B66D 1/39; B66D 1/36; B66D 2700/0191
See application file for complete search history.

(56) References Cited

U.S. PATENT DOCUMENTS 190,811 A * 5/1877 Bevelander ..... B65H 75/4402 242/397.2
342,038 A * 5/1886 Pugh ..... B66D 3/24 254/276
1,941,250 A 12/1933 Dale
RE20,191 E 12/1936 Mathey et al.
2,348,987 A * 5/1944 Lock ..... B66D 1/38 200/47
2,483,688 A * 10/1949 Brown ..... B66D 1/36 242/397.3
2,641,413 A 6/1953 Bruestle
2,660,382 A * 11/1953 Wilson ..... B66D 1/36 242/157.1
2,704,191 A * 3/1955 Schley ..... B21C 47/04 242/147 R
2,900,145 A * 8/1959 Hanson ..... B65H 54/2863 242/478.2
2,904,284 A 9/1959 Newsom
3,095,183 A 6/1963 Le Bus, Sr.
3,456,898 A 7/1969 Anderson et al.
3,456,899 A * 7/1969 Burch ..... B66D 1/39 242/484
3,507,458 A * 4/1970 White ..... B65H 54/2866 242/478.2
3,552,682 A * 1/1971 Walsh ..... B63B 21/58 242/397.3
3,809,334 A * 5/1974 Beurer ..... B64D 1/22 242/390.2

(Continued)

*Primary Examiner* — Michael E Gallion
(74) *Attorney, Agent, or Firm* — Phillips Murrah PC; Martin G. Ozinga

(57) ABSTRACT

The present invention is an apparatus, system and method for use for winding and unwinding reels having a level wind carriage adapted to lay a cable back and forth across a drum of a spool by changing travel direction when contacting a first ring and a second ring of a tripping bar respectively.

1 Claim, 6 Drawing Sheets

(56) References Cited

U.S. PATENT DOCUMENTS 3,815,846 A * 6/1974 Biewer ..... B65H 54/2866 242/157.1
4,005,834 A * 2/1977 Landreau ..... B65H 54/2812 242/478.1
4,143,834 A * 3/1979 Hara ..... B65H 54/2851 242/477.6
4,150,801 A * 4/1979 Ikegami ..... H01F 41/082 242/478.1
4,235,394 A * 11/1980 Fry ..... B65H 54/2854 242/397.3
4,334,670 A * 6/1982 Kawabe ..... B66D 1/38 242/397.3
4,455,961 A * 6/1984 Hansen ..... B66D 1/38 114/242
4,685,631 A 8/1987 Kurtz et al.
4,695,010 A * 9/1987 Smith ..... B66D 1/38 242/157.1
5,823,459 A * 10/1998 York ..... B65H 54/44 242/471
6,435,447 B1 * 8/2002 Coats ..... B65H 54/2848 242/157.1
6,443,431 B1 * 9/2002 Stasny ..... B66D 1/38 242/157.1
6,811,112 B1 * 11/2004 Currie ..... B65H 54/2872 242/157.1
8,616,529 B2 * 12/2013 Kim ..... B66D 1/50 254/335
8,657,261 B2 * 2/2014 Mehrkens ..... A63C 11/10 254/323
9,248,999 B2 * 2/2016 Xydias ..... B66D 1/38
9,783,399 B2 * 10/2017 Hausladen ..... B66D 1/30
10,093,522 B1 * 10/2018 Baugh ..... B66D 1/38
2005/0087644 A1 * 4/2005 Kim ..... B65H 75/425 242/390.8
2008/0258124 A1 * 10/2008 Farmer ..... B66D 1/38 254/323
2014/0166953 A1 * 6/2014 Wright ..... B66D 1/56 254/270
2015/0266707 A1 * 9/2015 Holmberg ..... B66D 1/12 254/362
2016/0362947 A1 12/2016 Baugh
2016/0362948 A1 * 12/2016 Baugh ..... E21B 17/01
2017/0166422 A1 * 6/2017 Mahnken ..... A62B 35/00
2017/0254160 A1 9/2017 Baugh

* cited by examiner

REVERSING LEADSCREW APPARATUS, SYSTEM AND METHOD

CROSS-REFERENCE TO RELATED APPLICATIONS

Priority is claimed from U.S. Provisional Application Ser. No. 62/256,818 filed on Nov. 18, 2016 and incorporated by reference herein.

BACKGROUND OF INVENTION

1. Field of the Invention

In general, the present invention relates to an apparatus, system and method for coiling cables on reels. More particularly, the present invention provides a new and improved reel and or winch assembly having a non-diamond and non-electrical leadscrew assembly, which will reverse its rotation as it moves towards each side of a spool to lay a cable back and forth across the drum of the spool automatically.

2. Description of the Prior Art

Offshore equipment is frequently lowered into the ocean water and landed on the ocean floor by a winch handling a wire rope cable. Winches are much like the reels on a fishing rod, only much larger and heavier duty. As the tension load requirement increases, the spool will become thicker walled and heavier and the motors must become more powerful. Often times, especially in the case of remotely operated vehicles (ROVs), the core of the cable will include electrical and fiber optic lines. In the case of ROVs, the tension on the line will be up to 40,000 lbs. On other packages, the load can be higher or lower.

The cable is typically neatly wrapped onto the drum of the spool by a level wind, which is moved by a "diamond" screw or a lead screw. The "diamond" screw is similar to the ones that you see on fishing reels where the crisscross pattern of grooves followed by a key or pawl provides a series of diamond shapes. For heavy duty winches, especially winches for which the line goes out the side parallel to the axle of the spool, the loads between the diamond screw groove and the pawl in the level wind carriage are too high for a diamond screw type level wind. The limited and intermittent contact area between the two are simply too stressful for a reasonable service life of the components. In this case, a threaded leadscrew type is preferred as the contact between the leadscrew and the threaded nut in the level wind carriage has much more surface area available to distribute the stresses, as well as not being intermittent.

When a threaded leadscrew is used, its direction of rotation must be reversed when reaching each side of the spool so the cable can be laid back and forth on each successive layer of cable. To date this has implied the increase in complexity of the system to electrical signals to sense the extent of movement and motors capable of reversing direction. The only other option to this would be human intervention at just the right moment as the side of the spool is approached It has been long understood that an all mechanical system, which would reverse the rotational direction of the lead screw would simplify the design of the winches and reels, especially in environments that have explosive content. When explosives gases are present, the electrical equipment must be rated for "explosion proof service", which is even more complex and expensive to do and certify.

Prior art attempts at improvements to this problem have obviously not provided the desired solutions. Thus, there is a need for an apparatus, process and or system that provides a reversing means for coiling cable on a drum for winches and or reels. The above discussed limitations in the prior art is not exhaustive. The current invention provides an inexpensive, time saving, more reliable apparatus, method and system for winches and or reels where the prior art fails.

SUMMARY OF THE INVENTION

In view of the foregoing disadvantages inherent in the known types of leadscrew assemblies utilized with large winch and reel applications now present in the prior art, the present invention provides a new and improved apparatus, system and method of using non-diamond and non-electrical leadscrew. As such, the general purpose of the present invention, which will be described subsequently in greater detail, is to provide a new and improved automatically reversing leadscrew, which has all the advantages of the prior art devices and none and or fewer of the disadvantages.

It is, therefore, contemplated that the present invention is an apparatus, system and method for use for winding and unwinding reels that may comprise a mechanical, non-electrical, and automatic system that allows winding from side to side of a reel and unwinding.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved leadscrew apparatus, system and method of utilizing same to provide for reversing the leadscrew on a reel or winch without needing electrical or manual intervention and may eliminate the need for a diamond leadscrew while providing the same functionality.

Furthermore, an object of the present invention is to provide a new and improved leadscrew apparatus, system and method of utilizing same to provide dual clutches with detent mechanisms whereby the engagement of the clutches is positive, but where one clutch may not or cannot be engaged before the second clutch is disengaged.

Another object of the present invention is to provide a new and improved leadscrew apparatus, system and method of utilizing same to provide dual clutches with detent mechanisms a central section, which engages both clutch faces such that the central section is not released from one clutch face until sufficient spring force is stored to move the central section to rapid and full engagement with the other clutch face.

It is a further object of the present invention to provide a new and improved leadscrew apparatus, system and method of utilizing same, which is of a durable and reliable construction and may be utilized in numerous types of reel and or winch applications.

An even further object of the present invention is to provide a new and improved leadscrew apparatus, system and method of utilizing same, which is susceptible to a low cost of manufacture, installation and labor, which accordingly is then susceptible to low prices of sale to the consuming industry, thereby making such a system economically available to those in the field.

Still another object of the present invention is to provide a new and improved leadscrew apparatus, system and method of utilizing same, which provides all of the advantages of the prior art while simultaneously overcoming some of the disadvantages normally associated therewith.

These, together with other objects of the invention, along with the various features of novelty, which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF THE PICTORIAL ILLUSTRATIONS, GRAPHS, DRAWINGS, AND APPENDICES

The invention will be better understood and objects other than those set forth above will become apparent when consideration is given to the following detailed description thereof. Such description makes reference to the annexed pictorial illustrations, graphs, drawings and appendices.

DETAILED DESCRIPTION OF INVENTION

Figure 1:
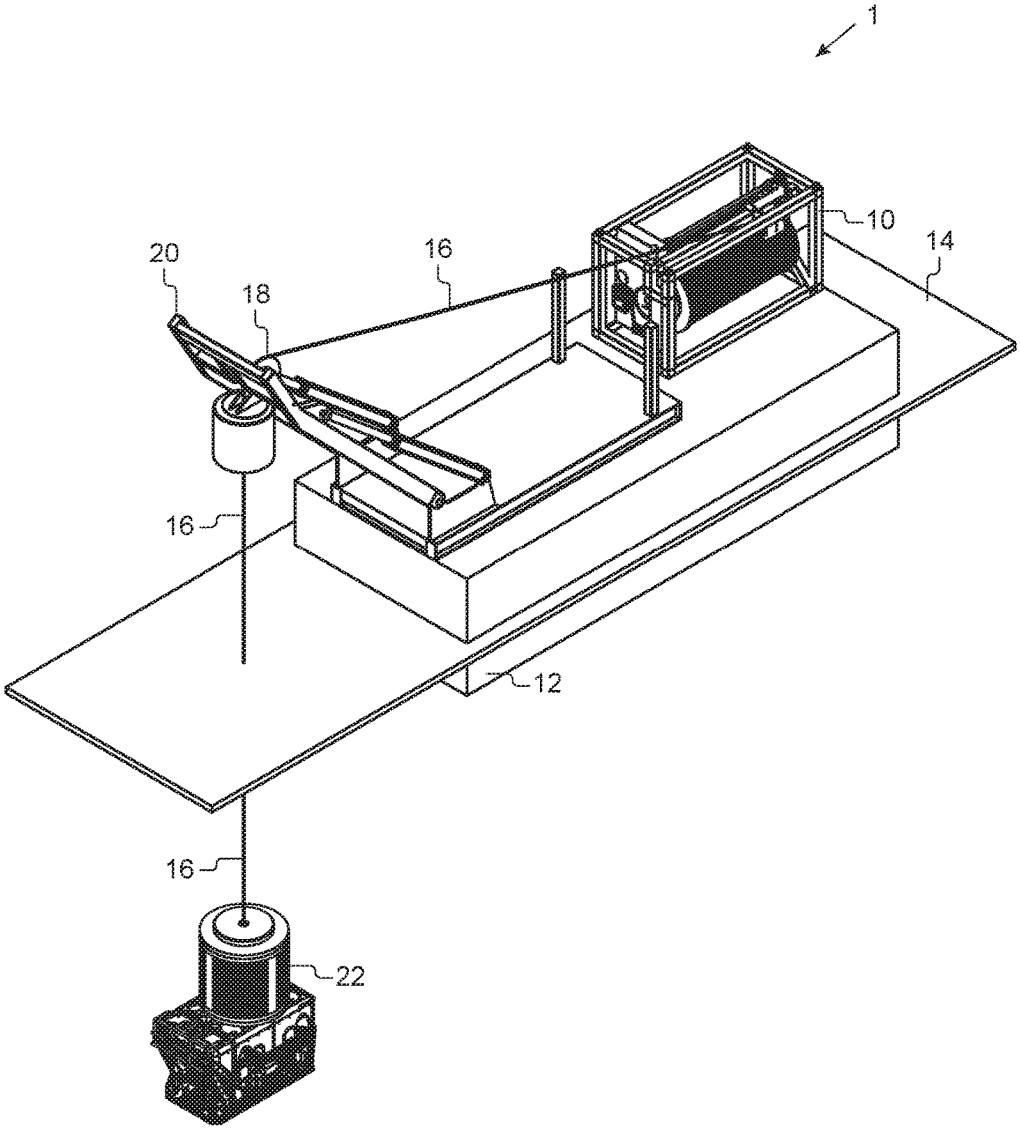
FIG. 1 is a general illustration of a preferred embodiment in accordance with the invention depicting an offshore service vessel with a winch.

Referring to the illustrations, drawings and pictures, reference character 1 generally designates a new and improved reel and or winch assembly, apparatus, system and method of using same having a non-diamond and non-electrical leadscrew assembly, which will reverse its rotation as it moves towards each side of a spool to lay a cable back and forth across the drum of the spool automatically in accordance with the present invention. Invention 1 is generally used with reels and or winches with offshore applications but is to be understood that invention 1 may be utilized for non-offshore applications and may be utilized in other operations with reels and or winches in general. For purposes of convenience, the reference numeral 1 may generally be utilized for the indication of the invention, portion of the invention, preferred embodiments of the invention and so forth.

Referring now to FIG. 1, winch 10 is landed on an offshore service vessel 12 or the like in ocean 14. Cable 16 extends from the winch 10 over a sheave 18 on a mast 20 to lower a work package 22 into the ocean 14. The work package 22 shown is a remotely operated vehicle (ROV) but can be various tools and equipment, which needs to be lowered subsea as well as other applications in general.

Figure 2:
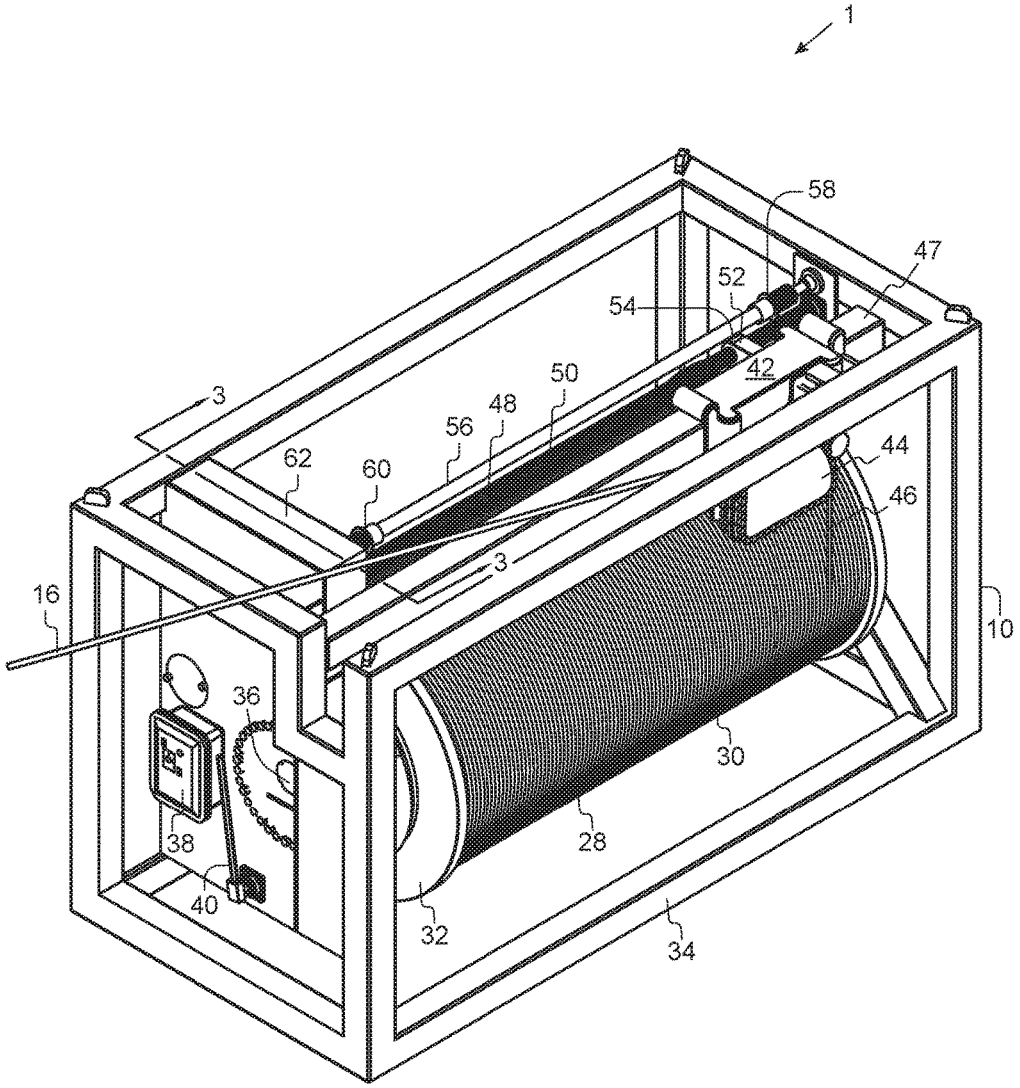
FIG. 2 is generally a closer perspective view of the winch of FIG. 1 in accordance with a preferred embodiment of the invention.

Referring now to FIG. 2, the winch 10 with the cable 16 extending out to the left coming from coil of cable 30 on drum 28 of spool 32. The spool 32 is mounted within frame 34 on rotating bearings (not shown). A motor 36 drives the spool 32 using controls 38 and manual/parking brake 40 is provided. The normal operational brake 40 will likely be integrated within the motor 36 for remote operations. A level wind carriage 42 is provided to be moved along the face of the spool as the cable 16 is removed from or added to coil of cable 30 to insure it is removed under a controlled circumstance and that it is laid on the spool 32 neatly during recovery.

Direction changing device 44 is shown as a part of level wind carriage 42 such that as cable portion 46 comes off coil of cable 30 and turns approximately ninety degrees to exit as shown at 16. Direction changing device 44 can be a full diameter wheel or sheave or can be a design such as the tracked device illustrated which requires considerable less space than the full diameter sheave.

As high tension winches must have the cabled loaded on with a high tension to prevent it from being destroyed when high tension is pulled on a loose wrap, direction changing device 44 can also be powered to provide a hold back force when a cable is installed. A typical ROV cable must be loaded with 12,000 lbs. tension when being installed on the spool, often requiring the entire winch be taken to shore for the installation. When the direction changing device 44 will hold back 12,000 lbs. tension, it allows the cable to simply and much less expensively be replaced offshore. In some cases of permanent installation with the winch welded in place, this will save a substantial number of operations and cost. A tractor mechanism of this type can be reviewed on U.S. Pat. No. 4,265,304.

Additionally, if cable changing device 44 will pull 12,000 lbs. of tension and 40,000 lbs. tension is required, it can mean that the spool portion of the winch can be reduced to 28,000 lbs. capacity. This will allow less metal and weight in the spool to withstand the stresses and the main motors can be considerably smaller.

Level wind carriage 42 moves along a track such as square tube 47 and is powered by rotating leadscrew 48, which provides a male thread 50. Level wind carriage 42 provides portion 52, which has an internal female threaded portion 54 to engage male thread 50. Tripping bar 56 provides adjustable first ring 58 and second ring 60, which are engaged by level wind carriage portion 52 as a portion of the means to reverse the rotational direction of leadscrew 48 as will be described later. Chain guard 62 houses chains and sprockets to power the level wind, as will be described later. Handle 64, depicted in FIG. 4, for the level wind adjusting clutch 66 is seen next to the chain guard 62. This handle and clutch are used to adjust the position of the cable to match the correct position on the spool.

Figure 3:
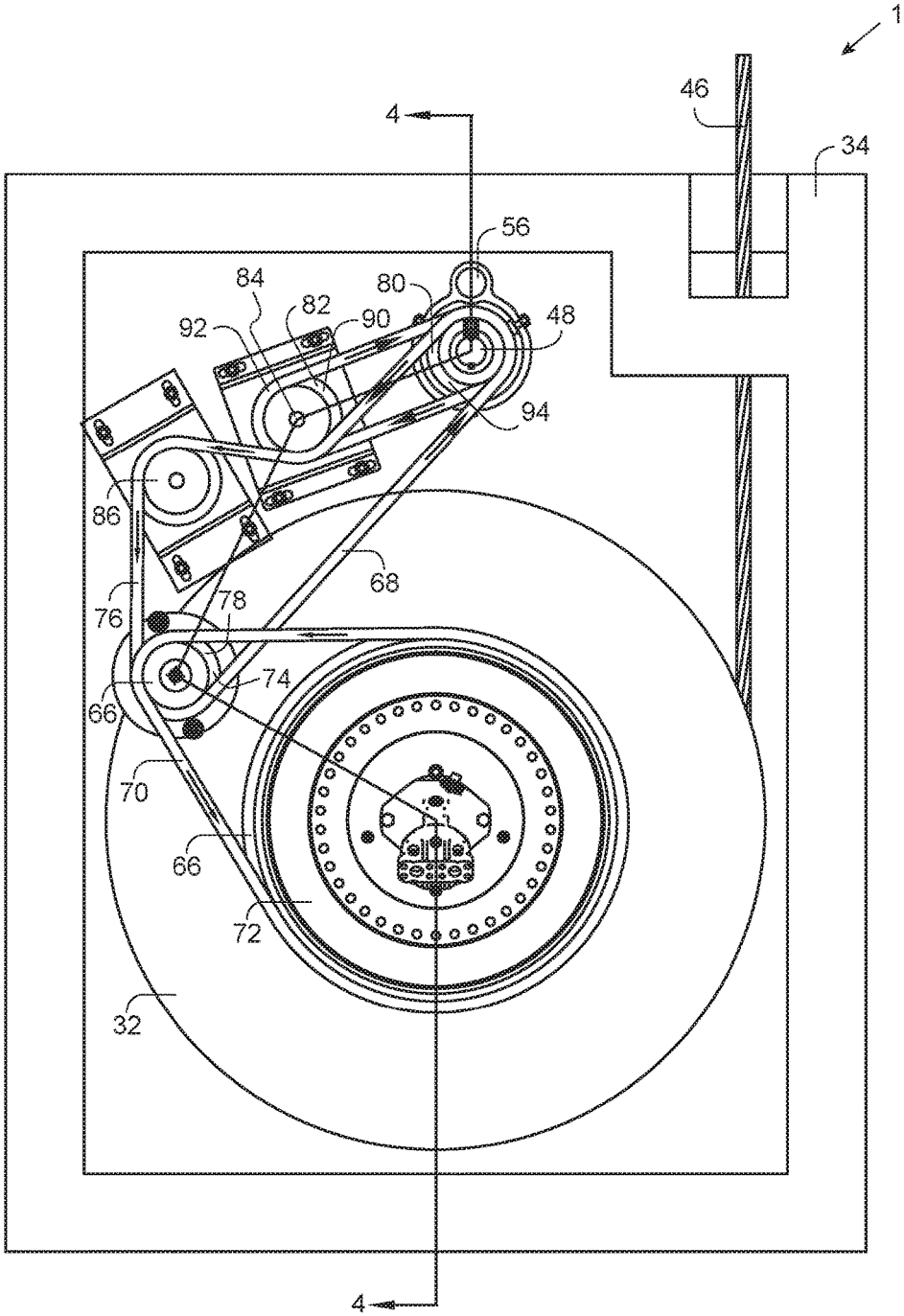
FIG. 3 is generally a partial cross section of FIG. 2 taken along lines "3-3" showing how drive chains may supply reversing power to the leadscrew in accordance with a preferred embodiment of the invention.

Referring now to FIG. 3, which is a partial cross section of FIG. 2 taken along lines "3-3" of FIG. 2, which generally shows leadscrew 48 drive assembly 68 which may utilize motor 36 to essentially turn leadscrew 48. It is understood that numerous configurations are contemplated and the current illustration should not be considered to limit the invention to same. Roller chain 70 is shown being driven by sprocket 72 and driving sprocket 74 on level wind adjusting clutch 66. Spool 32 and roller chain 70 are shown rotating in the direction of deploying the cable for subsea operations. Roller chain 76 is shown engaging another sprocket 78, which is hidden behind sprocket 74 on the level wind adjusting clutch 66, sprocket 80 on leadscrew 48, sprocket 82 on reversing axle 84, and idler sprocket 86, which is utilized for adjusting the tension on chain 76. Sprocket 90, which is hidden in the figure behind sprocket 82 drives roller chain 92 to power sprocket 94, which is hidden behind sprocket 80, but as sprockets 90 and 94 are on the opposite side of roller chain 76 than the other sprockets, sprocket 94 is driven in the opposite direction as sprocket 80. Sprockets 80 and 94 rotating in the opposite direction about leadscrew 48 provides a basic input for reversing the rotating direction of leadscrew 48.

Figure 4:
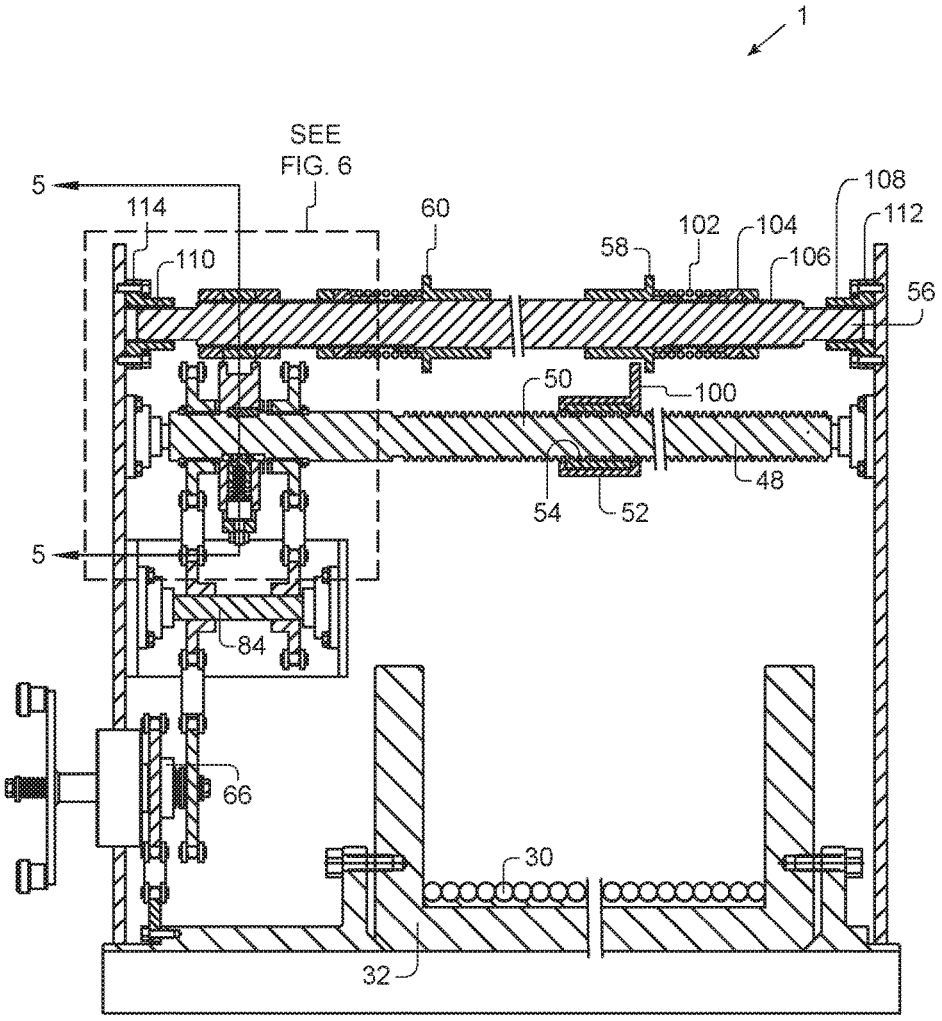
FIG. 4 is generally a partial cross section of FIG. 3 taken along lines "4-4" showing how the clutches may operate in accordance with a preferred embodiment of the invention.

Referring now to FIG. 4, which is a partial cross section of FIG. 3 taken along lines "4-4" showing how the clutches are operated. As level wind carriage 42 with portion 52 moves along rotating leadscrew 48, portion 52 or a specific portion 100 of portion 52 will engage adjustment first ring 58, which is slidably mounted on tripping bar 56. As adjustment first ring 58 slides to the right in the figure, spring 102 is compressed against double nut member 104, which is on thread 106 of tripping bar 56. When sufficient spring preload is built up, the clutch 66 will shift as will be described in FIG. 6. Bearing material 108 and 110 such as Teflon or Delrin is provided in bearing housings 112 and 114 to allow tripping bar 56 to move to the right or to the left to effect the shifting of the clutch 66. Yoke 116 may be mounted between nuts 118 and 120 on tripping bar 56 as better depicted in FIG. 6.

Figure 5:
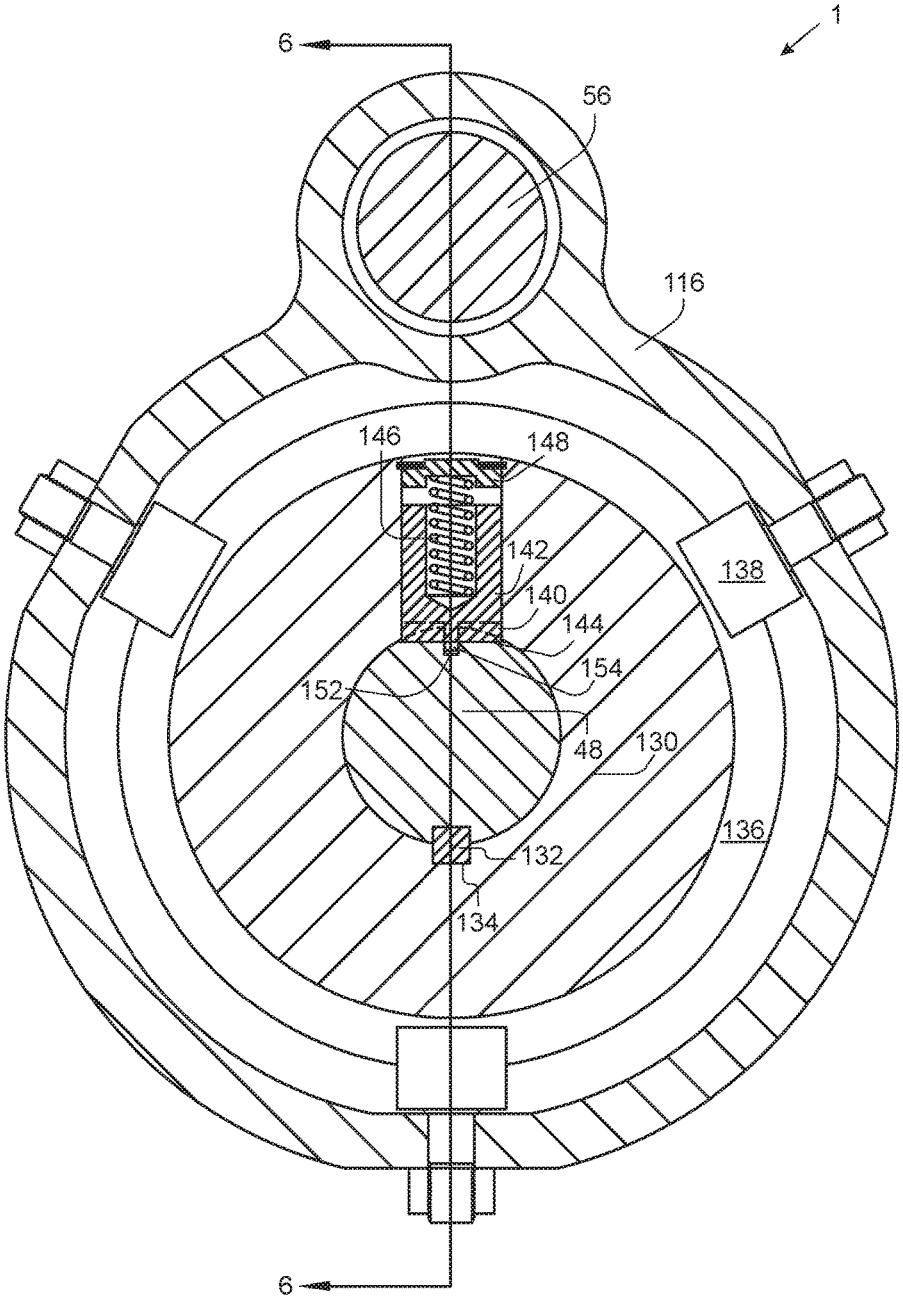
FIG. 5 is generally a partial cross section of FIG. 4 taken along lines "5-5" showing a closer view of the detent mechanism in accordance with a preferred embodiment of the invention.

Referring now to FIG. 5, which is a partial cross section of FIG. 4 taken along lines "5-5" showing a closer view of the detent mechanism showing yoke 116 around tripping bar 56 and rotating leadscrew 48. Clutch body 130 is shown around rotating leadscrew 48 with key 132, which is slidably mounted in groove 134 and causes clutch body 130 to rotate the same as the rotating leadscrew 48. Groove 136 in the perimeter of clutch body 130 is engaged by typical cam follower bearings 138 mounted on yoke 116, requiring that clutch body 130 move axially along rotating leadscrew 48 as yoke 116 is moved axially along tripping bar 56. Detent portion 140 of pawl body 142 is urged toward groove 144 in rotating leadscrew 48 by spring 146, which is retained by cap 148. Axial groove 152 is engaged by alignment pins 154 to maintain the correct orientation of pawl body 142.

Figure 6:
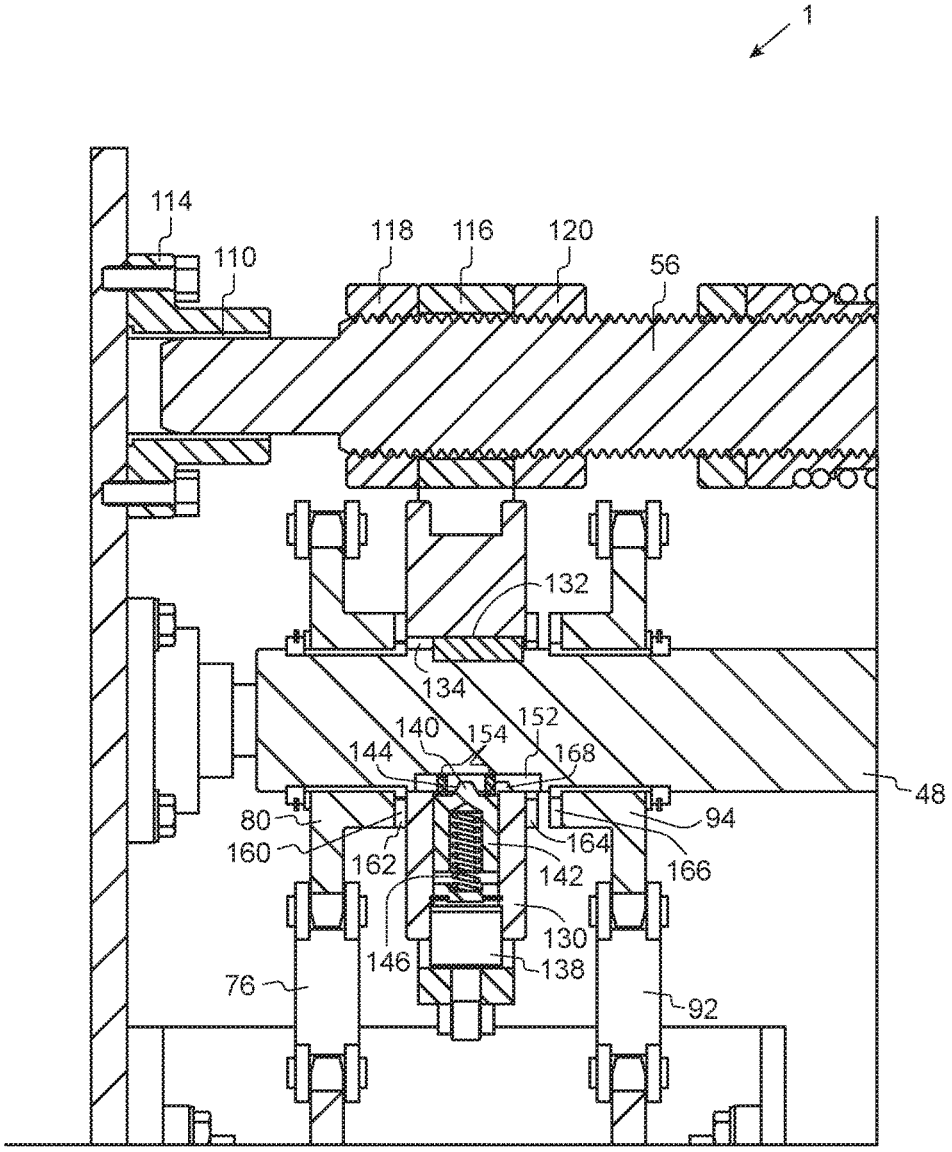
FIG. 6 is generally a closer view from a portion of FIG. 4 as indicated by a box defined by partial lines and the words "See FIG. 6" in accordance with a preferred embodiment of the invention.

Referring now to FIG. 6, which is a partial cross section of FIG. 5 taken along lines "6-6" and also indicated as SEE FIG. 6 on FIG. 4 showing a closer view of the detent mechanism. Detent portion 140 of pawl body 142 is shown in groove 144 in rotating leadscrew 48. In this position clutch teeth 160 on clutch body 130 are engaging clutch teeth 162 on sprocket 80. When the tripping bar 56 is sufficiently urged to the right as was seen in FIG. 4 the detent portion 140 will be urged out of groove 144 against the force of spring 146. The detent portion 140 will be out of groove 144 before clutch teeth 160 and 162 are disengaged, such that the final disengagement will be very rapid under spring load from the tripping bar 56. As it is spring loaded by spring 102 as seen on FIG. 4, it will continue movement until clutch teeth 164 on clutch body 130 are engaged with the clutch teeth 166 on sprocket 94 are positively engaged. As sprocket 94 is turning in the opposite direction to sprocket 80, the rotation of rotating leadscrew 48 will be reversed and thereby the direction of movement of the level wind carriage 42 will be reversed. By having a fixed number of clutch teeth at 160, 162, 164 and 166, a fixed and predictable travel to each end of the spool 32 by the level wind carriage 42 can be predicted.

It is therefore contemplated that invention 1 may be a winch comprising: a frame 34 having a first end and a second end; a spool 32 having a first end with a sprocket 72, a drum 28, a second end, a motor 36 for rotating said spool 32, and said spool 32 is mounted to said frame 34; a leadscrew 48 having a male threaded length 50, a first end rotatably attached to said frame 34 said first end and a second end rotatably attached to said frame 34 said second end; a tripping bar 56 having a length in parallel with said length of said leadscrew 48, a first end attached to said frame 34 said first end, a second end attached to said frame 34 said second end, a first ring 58 adjustably positioned on said length, and a second ring 60 adjustably positioned on said length; a tube 47 having a length in parallel with said length of said leadscrew 48, a first end attached to said frame 34 said first end, a second end attached to said frame 34 said second end; a drive assembly 68 adapted to rotate said leadscrew 48 with said motor 36 of said spool 32; and a level wind carriage 42 movably positioned on said length of said tube 47 and movably joined on said male threaded length 50 of said leadscrew 48 by a female thread 54 wherein said level wind carriage 42 is moved when leadscrew 48 is rotated and said level wind carriage 42 is adapted to lay a cable 30 back and forth across said drum 28 of said spool 32 by changing travel direction when contacting said first ring 58 and said second ring 60 of said tripping bar respectively.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

Changes may be made in the combinations, operations, and arrangements of the various parts and elements described herein without departing from the spirit and scope of the invention. Furthermore, names, titles, headings and general division of the aforementioned are provided for convenience and therefore, should not be considered limiting.

What is claimed is:

1. A winch comprising:

a frame having a first end and a second end;

a spool having a first end with a sprocket, a drum, a second end, a motor for rotating said spool, and said spool is mounted to said frame;

a leadscrew having a male threaded length, a first end rotatably attached to said frame said first end and a second end rotatably attached to said frame said second end;

a tripping bar having a length in parallel with said length of said leadscrew, a first end attached to said frame said first end, a second end attached to said frame said second end, a first spring loaded ring adjustably positioned on said length, and a second spring loaded ring adjustably positioned on said length;

a tube having a length in parallel with said length of said leadscrew, a first end attached to said frame said first end, a second end attached to said frame said second end;

a drive assembly adapted to rotate said leadscrew with said motor of said spool; and a level wind carriage movably positioned on said length of said tube and movably joined on said male threaded length of said leadscrew by a female thread wherein said level wind is moved when leadscrew is rotated and said level wind carriage is adapted to lay a cable back and forth across said drum of said spool by changing travel direction when contacting said first ring and said second ring of said tripping bar respectively.

* * * * *